US005321474A

United States Patent [19]

Bares

[11] Patent Number: 5,321,474

[45] Date of Patent: Jun. 14, 1994

[54] ACTIVE DAMPING OF ELECTRODE WIRE VIBRATION IN SCAVENGELESS DEVELOPMENT IN A XEROGRAPHIC APPARATUS

[75] Inventor: Jan Bares, Webster, N.Y.

[73] Assignee: Xerox Corporation, Stamford, Conn.

[21] Appl. No.: 28,865

[22] Filed: Mar. 10, 1993

[51] Int. Cl.[5] ..... G03G 15/08

[52] U.S. Cl. ..... 355/247; 118/654; 430/120

[58] Field of Search ..... 355/245, 249, 247, 202, 355/259, 261, 263, 264, 208; 118/647, 649, 653, 654; 430/120, 122

[56] References Cited

U.S. PATENT DOCUMENTS 4,868,600 9/1989 Hays et al. ..... 355/259
4,984,019 1/1991 Folkins ..... 355/215
5,010,367 4/1991 Hays ..... 355/247
5,031,570 7/1991 Hays et al. ..... 355/261 X
5,134,442 7/1992 Folkins et al. ..... 355/261 X
5,144,370 9/1992 Bares ..... 355/247
5,144,371 9/1992 Hays ..... 355/249

*Primary Examiner*—A. T. Grimley
*Assistant Examiner*—Shuk Y. Lee
*Attorney, Agent, or Firm*—R. Hutter

[57] ABSTRACT

In a scavengeless development apparatus, an electrode wire is disposed between a donor roll and a latent image to form a powder cloud of toner to develop the latent image. A magnet is disposed along the electrode wire, and low-frequency AC is passed through the electrode wire. The electromagnetic forces acting on the wire from the interaction of the AC with the magnetic field are adapted substantially to cancel mechanical vibration of the electrode wire.

8 Claims, 4 Drawing Sheets

ACTIVE DAMPING OF ELECTRODE WIRE VIBRATION IN SCAVENGELESS DEVELOPMENT IN A XEROGRAPHIC APPARATUS

The present invention relates to developer apparatus for electrophotographic printing. More specifically, the invention relates to controlling the vibration of an electrode wire in a scavengeless development process.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development". The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll". The developer roll is typically in the form of a cylindrical sleeve rotating around a fixed assembly of permanent magnets. The carrier beads form chains extending from the surface of the developer roll, and the toner particles are electrostatically attached to the chains of carrier beads. When the magnetic brush is introduced into a development zone adjacent the electrostatic latent image on a photoreceptor, the electrostatic charge on the photoreceptor will cause the toner particles to be pulled of the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be pulled from the developer to the photoreceptor.

An important variation to the general principle of development is the concept of "scavengeless" development. The purpose and function of scavengeless development are described more fully in, for example, U.S. Pat. No. 4,868,600. In a scavengeless development system, toner is made available to the photoreceptor by means of AC electric fields supplied by self-spaced electrode structures, commonly in the form of wires extending across the photoreceptor, positioned within the nip between a donor roll and photoreceptor. Because there is no physical contact between the development apparatus and the photoreceptor, scavengeless development is useful for devices in which different types of toner are supplied onto the same photoreceptor, as in "tri-level" or "recharge, expose, and develop" highlight or image-on-image color xerography.

A typical "hybrid" scavengeless development apparatus includes, within a developer housing, a transport roll, a donor roll, and an electrode structure. The transport roll operates in a manner similar to a developer roll, but instead of conveying toner directly to the photoreceptor, conveys toner to a donor roll disposed between the transport roll and the photoreceptor. The transport roll is electrically biased relative to the donor roll, so that the toner particles are attracted from the transport roll to the donor roll. The donor roll further conveys toner particles from the transport roll toward the photoreceptor. In the nip between the donor roll and the photoreceptor are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud, forming a toner powder image thereon.

Another variation on scavengeless development is single-component scavengeless development, also known as scavengeless SCD. In scavengeless SCD, the donor roll and the electrode structure create a toner powder cloud in the same manner as the above-described scavengeless development, but instead of using a magnetic brush to convey toner particles from the toner supply in the developer housing to the donor roll, a portion of the donor roll is exposed directly to a supply of single-component developer, which is pure toner. Scavengeless SCD provides the same advantages as the basic case of hybrid scavengeless development, and is useful in situations where the size, weight, or power consumption of the apparatus is of particular concern.

In scavengeless developing systems wherein the electrode member in the development zone is in the form of one or more thin wires, an important practical problem arises when the wire is, for whatever reason, caused to vibrate. In practical applications of scavengeless development, it has been found that in the course of use the electrode wires tend to vibrate at a frequency of less than 1 kHz, much like a string on a musical instrument. This mechanical vibration of the electrode wire is, in effect, a constant repositioning of the electrode wire (and, more importantly, the electrostatic effects of the electrode wires) on a periodic basis. Because the rapid back-and-forth motion of the vibrating electrode wire is comparable in speed to the motion of the moving photoreceptor, such vibration is likely to have a noticeable effect on the development properties in the development zone. In particular, the vibration of the electrode wires will cause an effect called "strobing" in which the intensity of the placement of toner on the photoreceptor will vary periodically as the photoreceptor moves past the wire, causing a conspicuous set of stripes or bands on the finished copies. It is therefore a significant concern to designers of scavengeless development systems to reduce the strobing effect, particularly by reducing the mechanical vibration of the electrode wires.

U.S. Pat. No. 4,984,019 discloses a scavengeless-type development apparatus in which the electrode wires therein are deliberately mechanically vibrated to remove contaminants therefrom.

U.S. Pat. No. 5,144,370 discloses one technique of eliminating the unwanted mechanical vibration of electrode wires in scavengeless apparatus. The vibration of the electrode wires is detected by a vibration detector such as a microphone. The vibrational signal from this microphone is then phase-shifted, and a mechanically compensating mechanical vibration is re-introduced into the electrode wire, to cancel out the natural vibration.

U.S. Pat. No. 5,204,719, invented by the present inventor and assigned to the assignee of the present application, discloses the use of a permanent magnet for passive damping of mechanical vibration of an electrode wire in a scavengeless development apparatus.

According to the present invention, there is provided apparatus for developing an electrostatic latent image without strobing. A housing defines a chamber for storing a supply of developer material. A donor roll, mounted at least partially in the chamber of the housing, advances developer material to the latent image. An electrode wire is positioned between the latent image and the donor roll, closely spaced from the donor roll and electrically biased to detach toner particles from the donor roll so as to form a toner powder cloud in the space between the electrode member and the latent image, so that detached toner particles from the toner cloud develop the latent image. A magnet provides a magnetic field encompassing at least a portion of the electrode wire. A mechanical vibration detector associated with the electrode wire outputs a signal related to the frequency and phase of mechanical vibration in the electrode wire. An alternating current source, operatively associated with the mechanical vibration detector, outputs to the electrode wire alternating current of a frequency and phase which is suitable for canceling the mechanical vibration in the electrode wire in conjunction with the magnetic field.

In the drawings

Inasmuch as the art of electrophotographic printing is well known, the various processing stations employed in the FIG. 5 printing machine will be shown hereinafter schematically and their operation described briefly with reference thereto.

Figure 5:
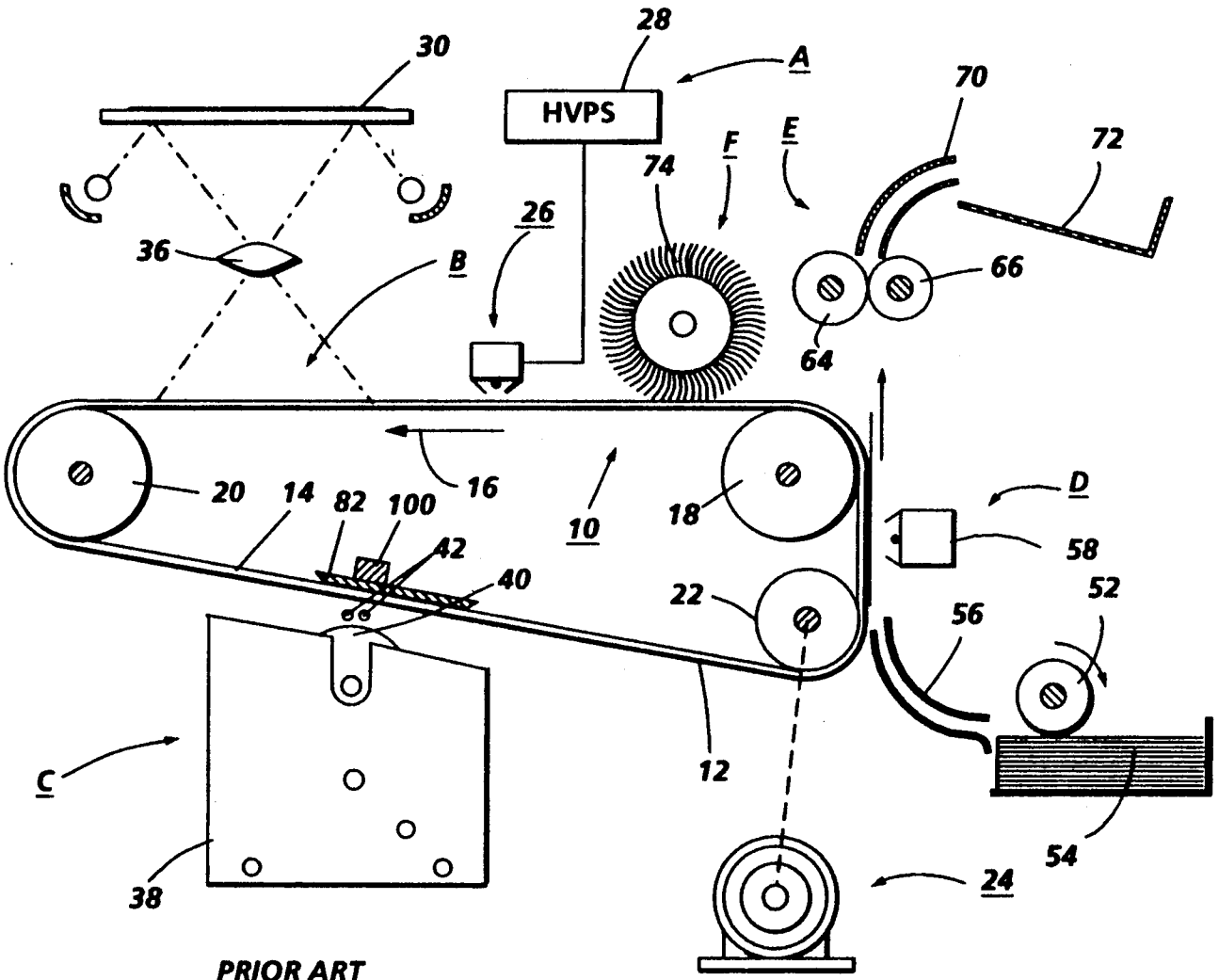
FIG. 5 PRIOR ART
FIG. 5 is a simplified elevational view of an electrophotographic printing apparatus in which the present invention may be embodied.

Referring initially to FIG. 5, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy which is electrically grounded. The belt is driven by means of motor 24 along a path defined by rollers 18, 20 and 22, the direction of movement being counter-clockwise as viewed and as shown by arrow 16. Initially a portion of the belt 10 passes through a charge station A at which a corona generator 26 charges surface 12 to a relatively high, substantially uniform, potential. A high voltage power supply 28 is coupled to device 26. After charging, the charged area of surface 12 is passed to exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a development system housed in housing 38 develops the latent image recorded on the photoconductive surface. Preferably, development system includes a donor roller 40 and electrode wires positioned in the gap between the donor roll and photoconductive belt. Electrode wires 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in the chamber of developer housing 44. The chamber in developer housing 44 stores a supply of developer material. The developer material is a two component developer material of at least magnetic carrier granules having toner particles adhering triboelectrically thereto. A transport roller disposed interiorly of the chamber of housing 38 conveys the developer material to the donor roller. The transport roller is electrically biased relative to the donor roller so that the toner particles are attracted from the transport roller to the donor roller. A permanent magnet 100 is disposed on the side of the photoreceptor 100 opposite that of electrode wires 42, and causes the wires 42 to be encompassed in a magnetic field. The development apparatus will be discussed hereinafter, in greater detail, with reference to FIG. 3.

After the electrostatic latent image has been developed, belt 10 advances the developed image to transfer station D, at which a copy sheet 54 is advanced by roll 52 and guides 56 into contact with the developed image on belt 10. A corona generator 58 is used to spray ions on to the back of the sheet so as to attract the toner image from belt 10 to the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from pohotoconductive surface 12 of belt 10, the residual toner particles adhering to photoconductive surface 12 are removed therefrom by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 3:
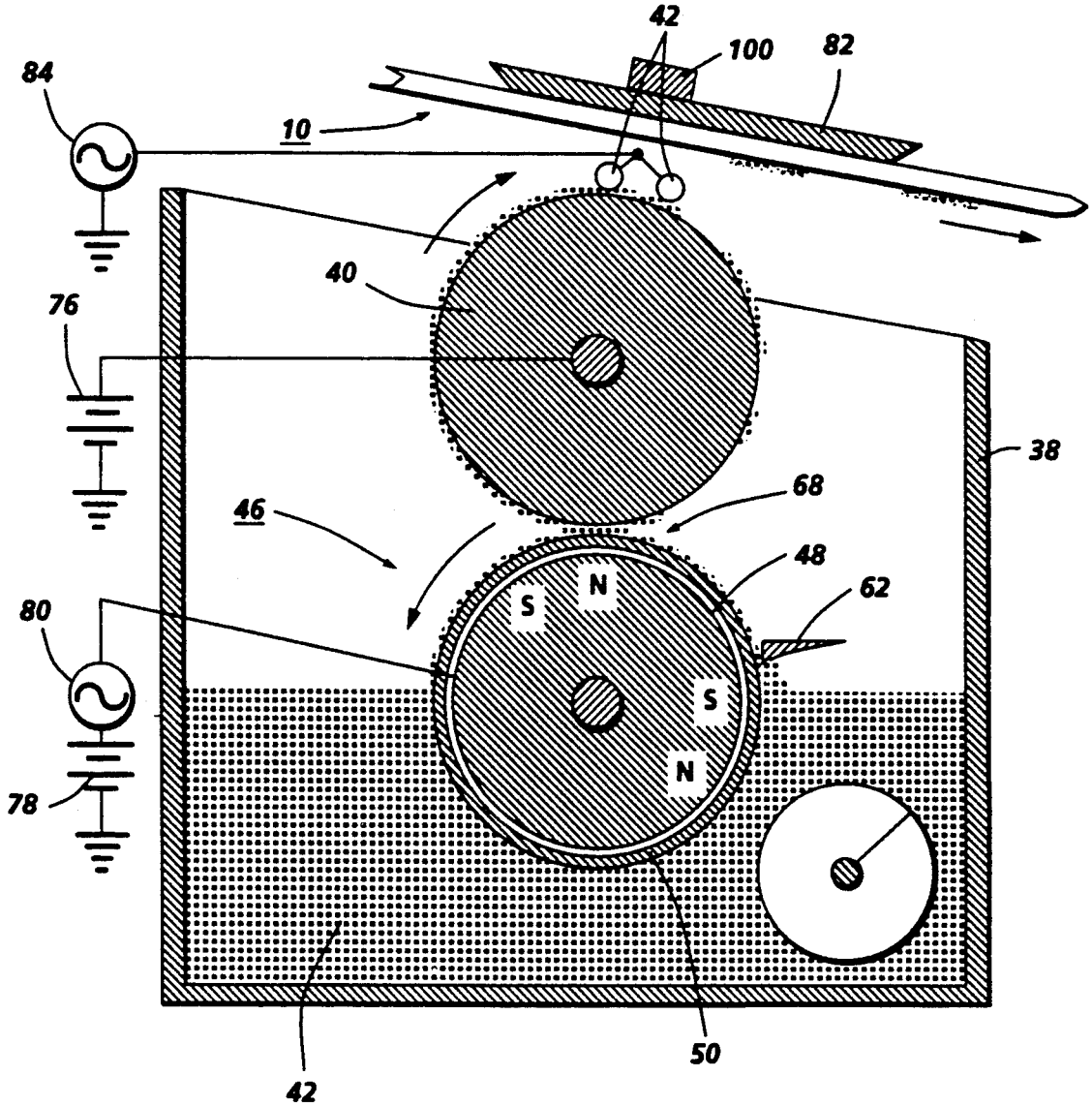
PRIOR ART FIG. 3
FIG. 3 is a simplified elevational view of a hybrid scavengeless development station.

Referring now to FIG. 3, there is shown a development system in greater detail. Housing 38 defines a chamber for storing a supply of developer material 47 therein. Positioned in the bottom of housing 38 is a horizontal auger which distributes developer material uniformly along the length of transport roll 46, so that the lowermost part of roll 46 is always immersed in a body of developer material.

Transport roll 46 comprises a stationary multi-polar magnet 48 having a closely spaced sleeve 50 of non-magnetic material, preferably aluminum, designed to be rotated about the magnetic core 48 in a direction indicated by the arrow. Because the developer material includes magnetic carrier granules, the effect of the sleeve rotating through stationary magnetic fields is to cause developer material to be attracted to the exterior of the sleeve. A doctor blade 62 is used to limit the radial depth of developer remaining adherent to sleeve 50 as it rotates to the nip 68 between transport roll 46 and donor roll 40. The donor roll is kept at a specific voltage, by a DC power supply 76, to attract a thin laey of toner particles transport roll 46 in nip 68 to the surface of donor roll 40. Either the whole of the donor roll 40, or at least a peripheral layer thereof, is preferably of material which has low electrical conductivity, as will be explained in detail below. The material must be conductive enough to prevent any build-up of electric charge with time, and yet its conductivity must be low enough to form a blocking layer to prevent shorting or arcing of the magnetic brush to the donor roll.

Transport roll 46 is biased by both a DC voltage source 78 and a AC voltage source 80. The effect of the DC electrical field is to enhance the attraction of developer material to sleeve 50. It is believed that the effect of the AC electrical field applied along the transport roll in nip 68 is to loosen the toner particles from their adhesive and triboelectric bonds to the carrier particles. AC voltage source 80 can be applied either to the transport roll as shown in FIG. 3, or directly to the donor roll in series with supply 76.

Electrode wires 42 are disposed in the space between the belt 10 and donor roll 40. A pair of electode wires are shown extending in a direction substantially parallel to the longitudinal axis of the donor roll 40. The electrode wires are made from of one or more thin (i.e. 50 to 100 μm diameter) steel or tungsteen wires which are closely spaced from donor roll 40. The distance between thw wires and the donor roll 40 is approximately 25 μm or the thickness of the toner layer formed on the donor roll 40. The wires are self-spaced from the donor roller by the thickness of the toner on the donor roller. To this end the extremities of the wires supported by the tops of end bearing blocks also support the donor roller for rotation. The wire extremities are attached so that they are slightly below a tangent to the surface, including toner layer, of the donor structure. Mounting the wires in such a manner makes them insensitive to roll runout due to their self-spacing. An alternating electrical bias is applied to the electrode wires by an AC voltage source 84. The applied AC establishes an alternating electrostatic field between the wires and the donor roller which is effective in detaching toner from the surface of the donor roller and forming a toner cloud about the wires, the height of the cloud being such as not to be substantially in contact with the belt 10.

At the region where the photoconductive belt 10 passes closest to donor roll 40, a stationary shoe 82 bears on the inner surface of the belt. The position of the shoe relative of the donor roll establishes the spacing between the donor roll and the belt. The position of the shoe is asjustable and it is positioned so that the spacing between the donor roll and photoconductive belt is preferably about 0.4 mm. Behind shoe 82 on the side thereof opposite the photoreceptor 10 is a permanent magnet 100, which is intended to provide a magnetic field which effectively encompasses the wires 42. The precise funtion of the magnet 100 in the context of the claimed invention will be described in detail below.

Another factor which has been found to be of importance is the speed with which the sleeve 50 is rotated relative to the speed of rotation of donor roll 40. In practice both would be driven by the same motor, but a gear train would be included in the drive system so that sleeve 50 is driven at a significantly faster surface velocity than is donor roll 40. A transport roll:donor roll speed ratio of 3:1 has been found to be particularly advantageous, and even higher relative speeds might be used in some embodiments of the invention. In other embodiments the speed ratio may be as low as 2:1.

Figure 4:
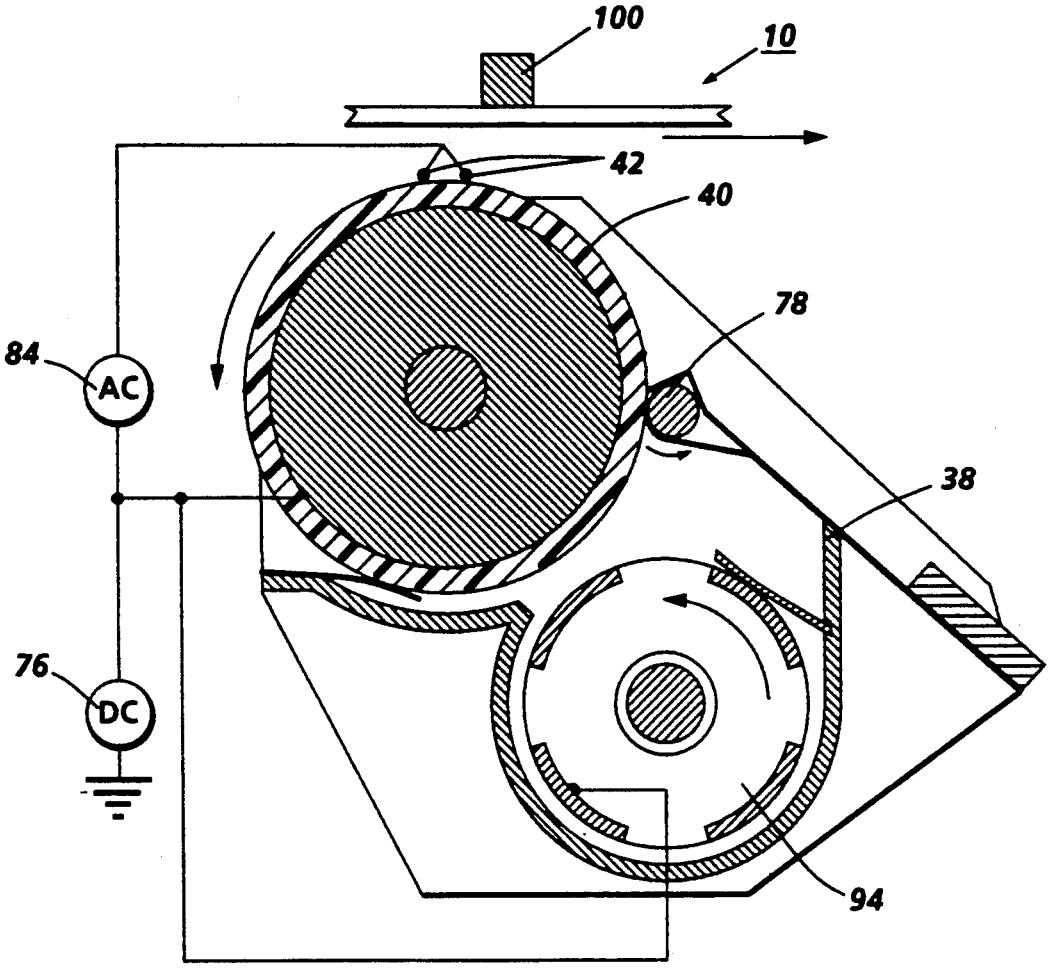
FIG. 4 PRIOR ART
FIG. 4 is a simplified elevational view of a single-component scavengeless development station.

FIG. 4 is a simplified plan view of a single-component scavengeless development station. In FIGS. 3 and 4, like reference numerals indicate like elements. As in the hybrid system of FIG. 3, the single-component system includes a donor roll 40 and electrode wires 42, but the donor roll 40 picks up toner to convey to the photoreceptor 10 directly from a supply of pure toner in the housing 38. In the single-component system of FIG. 4, there is no transport roll 46 and therefore no carrier beads are used in the developer. The specific design of the developer station in FIG. 4 may include special items useful in single-component developing, such as a charging rod 78 or electrically biased toner mover 94, the precise function of which is described in the above-referenced patent.

Figure 1:
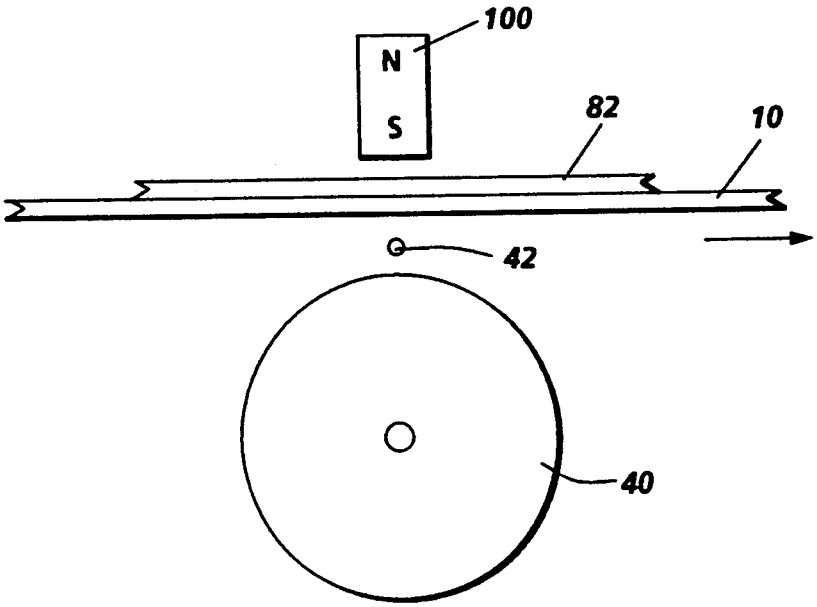
FIG. 1 is a simplified elevational view showing certain elements of a development system incorporating the present invention.

FIG. 1 shows the essential elements of a scavengeless system, be it of the hybrid or single-component variety, of interest to the present invention, shown in isolation. There is shown donor roll 40, upon which a supply of toner is introduced to a development zone. Disposed between the donor roll 40 and the charged photoreceptor 10 is an electrode wire 42. For purposes of explaining the present invention, only one electrode wire 42 is shown, but the present discussion will apply to systems in which multiple electrode wires are employed in the development zone.

As mentioned above, there is included a permanent magnet 100 adjacent the development zone on the side of photoreceptor 10 opposite that of electrode wire 42. Permanent magnet 100 is so disposed that a single magnetic pole is disposed toward the electrode wire 42, and preferably one pole (as shown, the south pole) extends substantially across the entire effective length of electrode wire 42. Permanent magnet 100 may be disposed behing the shoe 82, or may be formed integral with the shoe 82. The purpose of the permanent magnet 100 is to introduce a magnetic field into the development zone. When alternating current is caused to go through the electrode wire 42, in the presence of the magnetic field from permanent magnet 100, electromagnetic forces will cause the electrode wire to vibrate mechanically at a frequency at or near the frequency of the alternating current. This principle can be exploited to cancel out the mechanical vibration which occurs naturally in an electrophotographic apparatus.

In the basic case of scavengeless development, there is passing through electrode wire 42 an alternating current of a magnitude and frequency suitable for carrying out the development process itself; i.e., causing electrostatically charged toner particles to form a cloud in the development zone between donor roll 40 and photoreceptor 10. This "development" AC is, as mentioned above, preferably on the order of 2 kHz. The voltage for development purposes is typically in the range of 200–400 volts. However, because of the typically low resistance of a stainlesssteel or tungsten wire, the current draw in the wire for development purposes is quite low, and in fact it is possible to create a practical system wherein the development power is supplied at only one end of the electrode wire 42. What is contemplated in the present invention is to provide, in addition to the high-frequency development AC, a vibration-cancelling AC of a substantially lower frequency, that is, a frequency commensurate with the typical mechanical vibrations of electrode wire 42.

The vibration-cancelling AC is, in practical applications, almost always of a frequency of less than 1 kHz, and, in order to effectively cancel out the mechanical vibration, in a range of 10–20 volts. There are therefore two types of AC going through the electrode wire 42 simultaneously, and the two types of alternating current function, on the whole, independently of each other.

Figure 2:
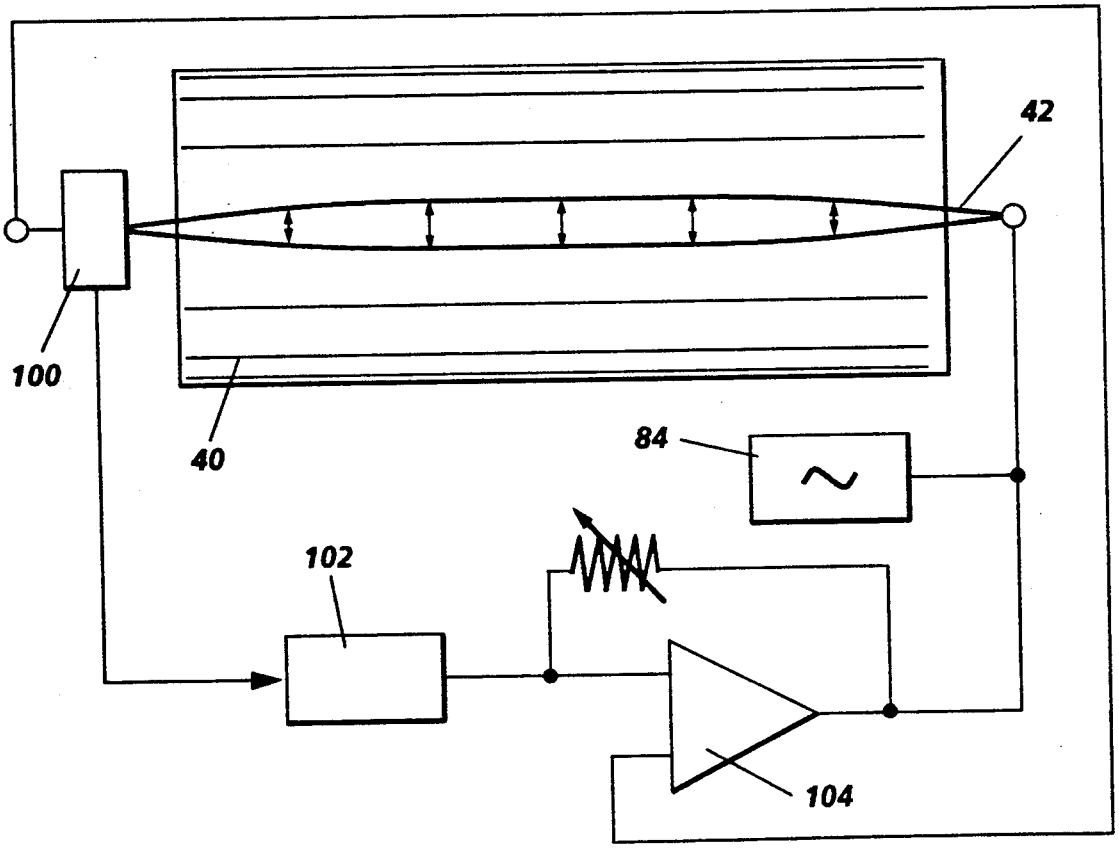
FIG. 2 is a partially-schematic plan view of certain elements of a development system incorporating the present invention.

FIG. 2 is a plan view of donor roll 40 and an electrode wire 42, and including, shown in schematic, the rudiments of a control system for providing the vibration-cancelling AC to electrode wire 42. In order for the system to determine the correct frequency for canceling the mechanical vibrations in electrode wire 42, the naturally-occurring vibrations in electrode 42 must first be detected. The frequency of the mechanical vibrations in electrode wire 42 may be affected by any of a number of external factors, such as presence of other vibrating elements within the apparatus, or the amount of toner material which may cake on the electrode wire 42, changing the vibrational dynamics thereof. There is for this purpose provided a detector 100. This detector 100 may be in the form of a small microphone, a music instrument pickup microphone, or a small accelerometer capable of detecting amplitude, frequency, and phase of the electrode wire 42. The detector 100 then sends a signal reflective of this amplitude, frequency, and phase to a controller 102. The purpose of controller 102 is to "answer" the amplitude and phase of the control signal from detector 100 with a counter signal of a comparable amplitude and opposite phase, which are used to cancel out the mechanical vibration. A circuit for providing this controller function, using analog or digital electronics, will be apparent to one skilled in the art of electronics. This counter signal is output from controller 102 and then fed into an amplifier 104, to be "stepped up" to an amplitude suitable for canceling out the mechanical vibrations of electrode wire 42. Controller 102 and amplfier 104 can together be construed as an alternating current source to output to the electrode wire alternating current of a frequency, amplitude, and phase which is suitable for canceling the mechanical vibration in the electrode wire in conjunction with the magnetic field. As can be seen in FIG. 2, the output of amplifier 104 is directly through electrode wire 42 and forms a complete circuit with the amplifier 104. Also on the loop through amplifier 104 and electrode wire 42 may be operatively disposed the AC voltage source 84 which establishes the "development" AC for scavengeless development. Once again, as mentioned above, the development AC from voltage source 84 and the vibration cancellation AC from amplifier 104 operate on the electrode wire 42 simultaneously, but otherwise function independently of each other.

One key advantage of the electromagnetic system of the present invention over purely mechanical vibration-cancellation systems is that, if the magnet 100 is disposed along the entire effective length of electrode wire 42, the cancellation effect, which is caused by the electromagnetic force created by the interaction of the vibration-cancellation AC with the field of permanent magnet 100, will be evident uniformly throughout the entire effective length of electrode wire 42. That is, the cancellation forces will have an effect at every point continuously along the electrode wire 42. In contrast, a mechanical system in which either adjusts the tension of the electrode wire 42 or mechanically introduces a counteracting vibration is likely to create, at least temporarily, complicated vibrational overtones within the electrode wire 42 as different mechanical frequencies act upon the electrode wire 42 simultaneously.

Although in FIG. 1 the permanent magnet 100 is disposed on the side of photoreceptor 10 opposite that of electrode wire 42, it is conceivable that the permanent magnet 100 may be disposed in other places adjacent the electrode wire 42. For example, the permanent magnet 100 could conceivably be disposed inside the donor roll 40 if the donor roll 40 is made hollow. One advantage of disposing permanent magnet 100 on the opposite side of photoreceptor 10 is that the possibility of the permanent magnet 100 interfering with other magnets in the development system, particularly in the transport roll in the hybrid scavengeless system, is minimized. At any rate, no matter where the permanent magnet 100 is placed, care should be taken that the presence of magnet 100 does not interfere with other processes in the development system which rely on permanent magnets.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. An apparatus for developing an electrostatic latent image on a charge receptor, comprising:

a housing defining a chamber for storing a supply of developer material therein;

a donor roll, mounted at least partially in the chamber of said housing, said donor roll being adapted to advance developer material to the latent image;

an electrode wire positioned between the latent image and the donor roll, the electrode wire being closely spaced from the donor roll and being electrically biased to detach toner particles from the donor roll so as to form a toner powder cloud between the electrode member and the latent image with detached toner particles from the toner cloud developing the latent image;

a magnet adapted to generate a magnetic field encompassing at least a portion of the electrode wire;

a vibration detector, associated with the electrode wire, to transmit a signal as a function of a frequency and phase of mechanical vibration of the electrode wire; and an alternating current source, operatively associated with the mechanical vibration detector, to transmit to the electrode wire alternating current of a frequency and phase adapted, in conjunction with the magnetic field, to substantially cancel the mechanical vibration in the electrode wire.

2. An apparatus as in claim 1, wherein the mechanical vibration detector is adapted to tramsmit a signal as a function of a amplitude of mechanical vibration of the electrode wire.

3. An apparatus as in claim 1, wherein the magnet is oriented with one pole thereof opposed from the electrode wire.

4. An apparatus as in claim 1, wherein the charge receptor is disposed between the magnet and the electrode wire.

5. An apparatus as in claim 1, further comprising a transport roll mounted rotatably in the chamber of the housing and positioned adjacent the donor roll, the transport roll being adapted to advance developer material to the donor roll, said donor roll being mounted rotatably.

6. An apparatus as in claim 5, further comprising means for applying an alternating electric field between the donor roll and the transport roll to assist in transferring at least a portion of the developer material from the transport roll to the donor roll.

7. A method of developing an electrostatic latent image recorded on a charge receptor, with a donor roll adapted to advance developer material to the latent image and an electrode wire positioned between the latent image and the donor roll, the electrode wire being electrically biased to detach toner particles from the donor roll so as to form a toner powder cloud between the electrode member and the latent image with detached toner particles from the toner cloud developing the latent image, comprising the steps of:

providing a magnetic field encompassing at least a portion of the electrode wire;

detecting a frequency and phase of mechanical vibration of the electrode wire; and transmitting, as a function of the detected frequency and phase of mechanical vibration, to the electrode wire alternating current of a frequency and phase which, in conjunction with the magnetic field, substantially cancels the mechanical vibration in the electrode wire.

8. A method as in claim 7, wherein the transmitting step includes transmitting to the electrode wire alternating current of an amplitude which, in conjunction with the magnetic field, substantially cancels the mechanical vibration in the electrode wire.

* * * * *